US006277016B1

(12) United States Patent
Koide

(10) Patent No.: US 6,277,016 B1
(45) Date of Patent: Aug. 21, 2001

(54) CORE DRILL FOR DRILLING FINE HOLE AND METHOD OF MANUFACTURING THE SAME

(76) Inventor: Akimichi Koide, 16-5, Togoshi 5-chome, Shinagawa-ku, Tokyo (JP)

( * ) Notice: Subject to any disclaimer, the term of this patent is extended or adjusted under 35 U.S.C. 154(b) by 0 days.

(21) Appl. No.: 09/174,458

(22) Filed: Oct. 19, 1998

(30) Foreign Application Priority Data

May 22, 1998 (JP) ..... 10-140729

(51) Int. Cl.[7] ..... B23F 21/03

(52) U.S. Cl. ..... 451/541; 451/532; 451/542; 451/547; 408/144

(58) Field of Search ..... 451/541, 542, 451/543, 547, 546, 532, 534; 408/144, 145

(56) References Cited

U.S. PATENT DOCUMENTS 72,509 * 12/1867 Lewis .
1,303,541 * 5/1919 Curtis .
3,142,138 * 7/1964 Kean et al. .
3,427,759 * 2/1969 Kistler et al. .
5,123,217 * 6/1992 Ishikawa et al. .
5,159,785 * 11/1992 Luber .
5,611,724 * 3/1997 DeGraaff .
6,004,198 * 12/1999 Sumiyoshi .

* cited by examiner

*Primary Examiner*—Timothy V. Eley
*Assistant Examiner*—Willie Berry, Jr.
(74) *Attorney, Agent, or Firm*—Arent Fox Kintner Plotkin & Kahn, PLLC

(57) ABSTRACT

An object of the invention is to provide a core drill for drilling a fine hole which can securely fix an abrasive grain to a core material, can finish to a predetermined diameter in a relatively easy manner, and can manufacture one having a superfine diameter about some $\mu$m, and a method of manufacturing the same. A core drill for drilling a fine hole in accordance with the invention for achieving the object is structured such as to drill a fine hole onto a work, or grind an inner diameter of the drilled fine hole to a predetermined shape, and characterized by bundling ceramics long fibers so as to make a core material, impregnating the core material with a molten synthetic resin so as to harden, and holding an abrasive grain by the synthetic resin.

1 Claim, 4 Drawing Sheets

CORE DRILL FOR DRILLING FINE HOLE AND METHOD OF MANUFACTURING THE SAME

BACKGROUND OF THE INVENTION

1. Field of the Invention

The present invention relates to a core drill for drilling a fine hole, which is used for drilling a fine hole having a diameter about some tens μm onto a work formed from a metal or a ceramics, or for grinding an inner diameter of the drilled fine hole to a predetermined shape, and a method of manufacturing the same.

For example, a core drill having no spiral groove for discharging chips and grinding powders is used as a tool for drilling a fine hole having a diameter about some tens μm onto the work or for grinding an inner diameter of the fine hole already drilled in accordance with an ultrasonic machining.

2. Description of Related Art

Conventionally, as this kind of core drill for drilling the fine hole, there has been known one structured such that an abrasive grain is fixed to a superfine core material in accordance with a plating treatment by a nickel or a copper after electro-coating a diamond abrasive grain or a ceramics abrasive grain on a surface of the core material such as a piano wire or a cemented carbide tungsten, and a diameter of the drill has been about 50 μm at the minimum.

However, since the diameter is fine, it is hard to uniformly electro-coat the abrasive grain on a periphery of the core material, so that there have been problems such as a plated film fixing the abrasive grain on the core material is easily broken away together with the abrasive grain when an external force is operated, in addition that the abrasive grains partly cohere so as to easily attach.

Further, since the diameter of the core drill is determined by a diameter of the core material and a thickness of the plated film, it is necessary to finely adjust the thickness of the plated film for finishing the diameter of the core drill at a predetermined accuracy, particularly in the case that the diameter of the drill is fine, the adjustment has been hard.

Still further, in the case that the core material is made of a metal material such as a piano wire, since there is a limitation for making the diameter of the core material fine, it is significantly hard to manufacture a core drill having a diameter finer than the current size in the manufacturing method which applying a plating treatment to the core material so as to fix the abrasive grain.

SUMMMARY OF THE INVENTION

The invention is made in view of the problems mentioned above, and an object thereof is to provide a core drill for drilling a fine hole which can securely fix an abrasive grain to a core material, can finish to a predetermined diameter in a relatively easy manner, and can manufacture one having a superfine diameter about some μm, and a method of manufacturing the same.

Accordingly, a core drill for drilling a fine hole in accordance with the invention is structured such as to drill a fine hole onto a work, or grind an inner diameter of the drilled fine hole to a predetermined shape, and characterized by bundling ceramics long fibers so as to make a core material, impregnating the core material with a molten synthetic resin so as to harden, and holding an abrasive grain by the hardened synthetic resin.

In accordance with this technical means, since the core material bundling the ceramics long fibers is impregnated with the synthetic resin so as to be hardened, the synthetic resin enters between the bundled ceramics long fibers, so that the core material and the synthetic resin are firmly united. Accordingly, a disadvantage such that the synthetic resin holding the abrasive grain is broken away from the core material during the use of the core drill can be avoided.

Further, since the synthetic resin fleshes out the periphery of the core material, it is possible to easily finish the diameter of the core drill to a predetermined diameter by plastically deforming the hardened synthetic resin by using a die and a pressure roller.

Further, since the diameter of the ceramics long fiber itself is some μm, the thickness of the core material can be freely adjusted by changing the number of the bundled ceramics long fibers, so that a core drill having a superfine diameter about some μm can be theoretically manufactured.

In this case, a certain degree of heat resistance and rigidity are required for the ceramics fiber forming the core material, a ceramics fiber of an alumina type or a zirconia type can be used. Further, even by a ceramic fiber having a rigidity lower than them, for example, a glass fiber can secure a rigidity necessary for the core drill since some ones are bundled so as to form the core material.

As the synthetic resin impregnated in the core material, either a thermosetting synthetic resin or a thermoplastic synthetic resin may be employed. As the thermosetting synthetic resin, an epoxy resin, a phenol resin or an unsaturated polyester can be used. Further, as the thermoplastic synthetic resin, taking into consideration that a temperature of the core drill is increased due to a friction heat at a time of processing the work, it is preferable that a temperature of thermal deformation is higher, so that, for example, a mixture of a polyphenylene sulfide (PPS) and a norbornen resin can be used.

On the contrary, the core drill for drilling the fine hole in accordance with the invention can be manufactured by the following two manufacturing methods.

At first, one of the manufacturing methods is characterized by comprising a first process for bundling ceramics long fibers so as to form a core material having a desired diameter, a second process for impregnating the core material with a molten synthetic resin, and thereafter, hardening it so as to form a drill material in which a synthetic resin fleshes out a periphery of the core material, and a third process for attaching an abrasive grain onto a surface of the drill material, and thereafter, inserting and fixing the abrasive grain to the synthetic resin at the same time when finishing the drill material to a predetermined diameter by a plastic formation.

Further, another of the manufacturing methods is characterized by comprising a first process for bundling ceramics long fibers so as to form a core material, a second process for impregnating the core material with a molten synthetic resin in which an abrasive grain is dispersed, and thereafter, hardening it so as to form a drill material in which a synthetic resin together with the abrasive grain flesh out a periphery of the core material, and a third process for finishing the drill material to a predetermined diameter by a plastic formation.

In the former manufacturing method, since the abrasive grain is later inserted on the surface of the drill material formed by the second process, that is, the surface of the synthetic resin covering the core material, the abrasive grain exists only on the surface of the core drill. On the contrary, in the latter manufacturing method, since the synthetic resin in which the abrasive grain is previously dispersed fleshes out the core material, the abrasive grain exists not only on the surface of the core drill but also near the core material.

Accordingly, the core drill manufactured by the former manufacturing method is suitable for a so-called lapping treatment for grinding an inner diameter of a prepared hole previously formed on the work, and on the contrary, the core drill manufactured by the latter manufacturing method is suitable for the case of drilling the fine hole on the work in accordance with an ultrasonic treatment.

Further, both of these manufacturing methods can manufacture the core drill having a predetermined length by forming the core material having a predetermined length in the first step and receiving the core material within an injection molding metal mold so as to flesh out the synthetic resin, however, a core drill having a significantly long size can be manufactured without being restricted by a size of the injection molding metal mold by continuously performing each of the first, second and third processes on the transfer path while continuously feeding a long core material. The long core drill manufactured in this manner may be used after being cut to a predetermined length, or as shown in Japanese Patent Unexamined Publication No. 8-155712, may be processed while continuously fed out with respect to the work.

Still further, in the second process of each of the manufacturing methods mentioned above, in the case of using a thermosetting resin as the synthetic resin fleshing out the core material, the synthetic resin is hardened while pressurizing and heating the core material impregnated with the synthetic resin, and on the contrary, in the case of using the thermoplastic resin, the synthetic resin is hardened while pressurizing and cooling the core material impregnated with the synthetic resin.

In accordance with the core drill for drilling the fine hole and the method of manufacturing the same of the invention, since the core material bundling the ceramics long fibers is impregnated with the molten synthetic resin so as to be hardened, the core material and the synthetic resin are firmly united, so that a disadvantage that the synthetic resin holding the abrasive grain is broken away from the core material during the use of the core drill can be avoided, and in addition, the diameter of the core drill can be easily finished to a predetermined diameter by plastically deforming the synthetic resin holding the abrasive grain by using the die and the pressing roller, and the thickness of the core material can be freely adjusted by changing the number of the bundled ceramics long fibers, so that the superfine core drill having a diameter about some $\mu$m can be manufactured.

DETAILED DESCRIPTION OF THE PREFERRED EMBODIMENTS

A core drill for drilling a fine hole and a method of manufacturing the same in accordance with the invention will be in detail described below with reference to the accompanying drawings.

Figure 1:
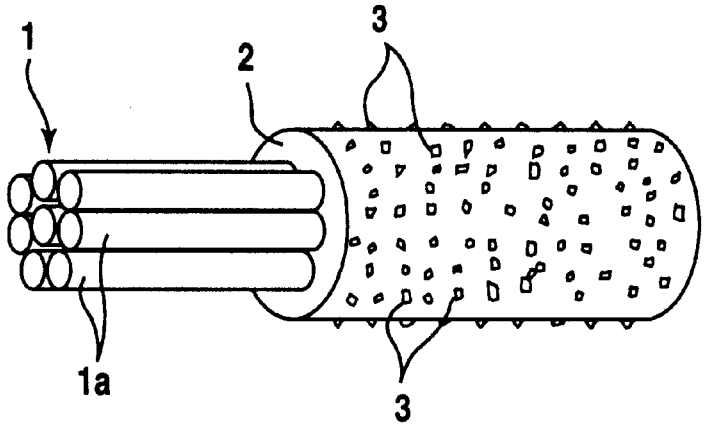
FIG. 1 is a cut-out perspective view which shows an embodiment of a core drill for drilling a fine hole in accordance with the invention.

FIG. 1 shows an embodiment of the core drill for drilling the fine hole in accordance with the invention, in which a thermoplastic synthetic resin is used as a synthetic resin flesh out a core material. In the drawing, reference numeral 1 denotes a core material formed by bundling a plurality of ceramics long fibers 1*a*, reference numeral 2 denotes a thermoplastic synthetic resin fleshing out a periphery of the core material 1 as a binder for an abrasive grain, and reference numeral 3 denotes an abrasive grain inserted on a surface of the thermoplastic resin 2.

The core material 1 is formed by bundling some alumina type ceramics long fibers la each having some $\mu$m, and a diameter thereof is about 80% the diameter of a final core drill. Accordingly, a diameter of the core material 1 can be suitably changed by optionally adjusting a number of the bundled ceramics long fibers 1*a*.

Further, as the thermoplastic resin 2, with taking into consideration that a temperature of the core drill is increased by a frictional heat at a time of processing the work, it is preferable as a temperature of a thermal deformation is higher, for example, a mixture having a polyphenylene sulfide (PPS) and a norbornen resin (trade name: ARTON, produced by Nihon synthetic rubber Co., Ltd.) at 60/40 weight % is used, and fleshes out the periphery of the core material 1 by means of an injection molding. That is, the core material 1 cut to a length about 300 to 400 mm is inserted into a metal mold, and a molten thermoplastic resin is injected and charged into a cavity of the metal mold at a predetermined injection pressure, whereby an injected resin is cooled and hardened within the cavity, so that the drill material in which the thermoplastic resin 2 fleshes out the periphery of the core material 1 can be formed. At this time, since the resin 2 is charged into the metal mold under a high pressure, the resin enters between some ceramics fibers 1*a* constituting the core material 1, so that the core material 1 and the thermoplastic resin 2 are firmly united.

Further, as the abrasive grain 3 mentioned above, a diamond abrasive grain or a ceramics abrasive grain is used, and an abrasive grain having a suitable grain diameter can be selected in accordance with a usage of the core drill. The abrasive grain 3 is pressure connected to the surface of the drill material taken out from the injection molding metal mold, and is held by the drill material so as to be inserted into the thermoplastic resin 2.

In the case that the diameter of the core drill is fine such as some tens $\mu$m, since it is hard to finish it to a predetermined diameter only by the injection molding, the thermoplastic resin 2 fleshes the core material 1 at a degree of a little thick at a time of the injection molding, so that the diameter of the drill material taken out from the metal mold is thicker than that of the final core drill. Accordingly, in the drill material taken out from the metal mold, the diameter thereof is finished by the plastic forming, and the abrasive grain 3 mentioned above is pressured connected to the surface of the thermoplastic resin at this time.

Figure 2:
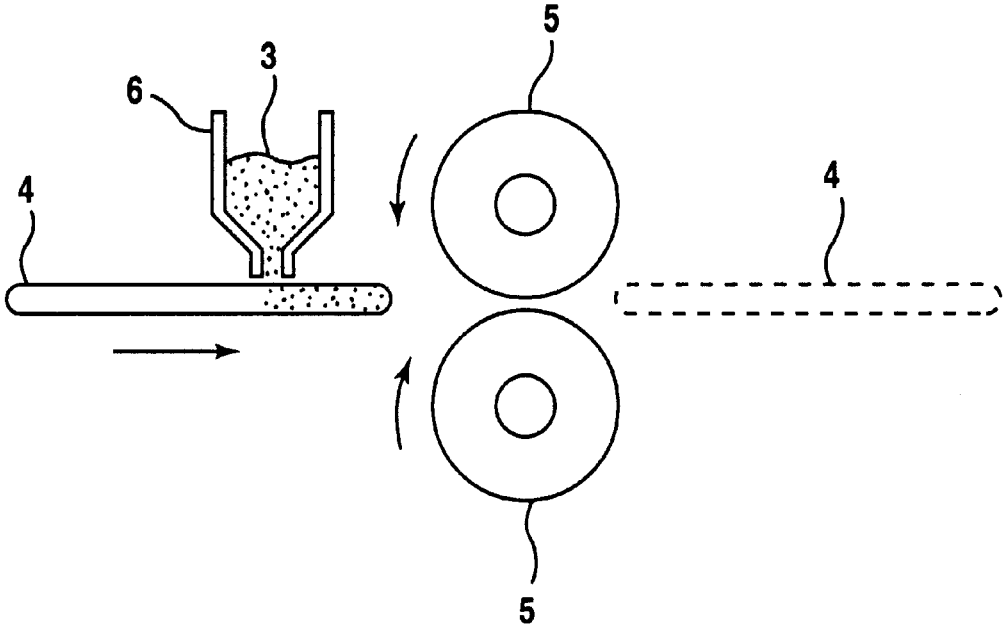
FIG. 2 is a schematic view which shows a process of finishing a drill material to a core drill having a predetermined diameter by using a pair of pressing rollers.
Figure 3:
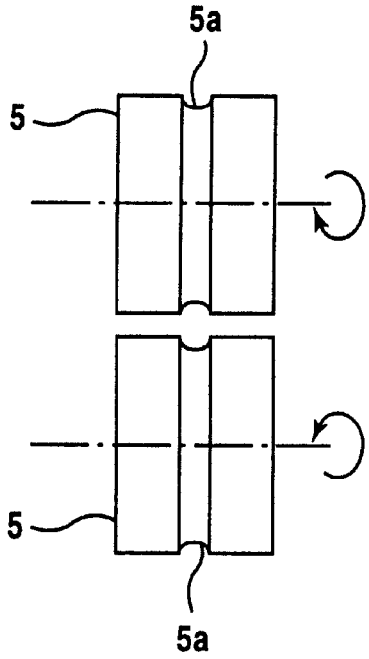
FIG. 3 is a front elevational view which shows a detail of a pair of pressing rollers.

FIG. 2 shows a process of pressure connecting the abrasive grain to the drill material injection-molded. A drill material 4 taken out from the metal mold is inserted between a pair of pressing rollers 5 and 5 so as to be plastically formed, however, a hopper receiving the abrasive grain 3 is provided immediately before the pressing rollers 5 and 5, so that the abrasive grain 3 can be uniformly attached to a peripheral surface of the drill material 4 inserted between the rollers 5 and 5. Further, as shown in FIG. 3, a groove 5*a* for finishing the drill material 4 to a predetermined diameter is formed on a peripheral surface of each of the pressing rollers 5 and 5, and the drill material 4 is drawn to a predetermined diameter by a plastic deformation of the thermoplastic resin 2 when passing between the pressing rollers 5 and 5.

Accordingly, the abrasive grain 3 attached on the surface of the drill material 4 is inserted into the thermoplastic resin 2 by a pressure connection of the pressing roller 5 by inserting the drill material 4 on which the abrasive grain 3 is attached between a pair of pressing rollers 5 and 5, and on the contrary, the drill material 4 is drawn to a predetermined diameter by a plastic deformation of the thermoplastic resin 2, so that the core drill having a predetermined diameter and a surface on which the abrasive grain 3 is uniformly held is completed.

Figure 4:
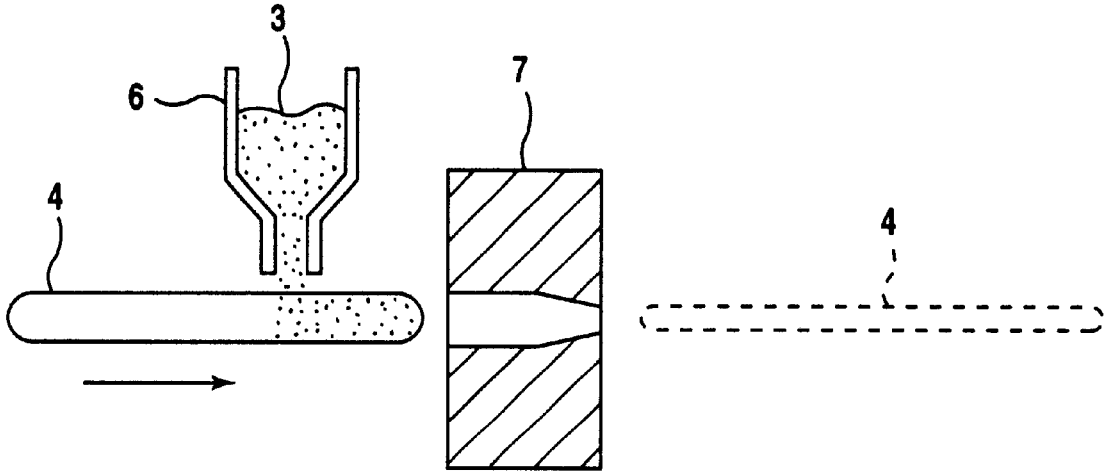
FIG. 4 is a schematic view which shows a process of finishing the drill material to the core drill having a predetermined diameter by using a die.

In this case, the pressing by the pressing rollers 5 and 5 is not limited to one time, and in the case that the finish diameter of the core drill is significantly fine, it may be repeatedly inserted between a plurality of pressing rollers 5 having grooves 5*a* with different diameters. Further, it is not necessary to always use the pressing roller 5 for plastically forming the drill material 4, as shown in FIG. 4, the structure may be made such that the diameter of the drill material 4 is drawn by inserting the drill material 4 to the die 7.

Further, it may be possible to add an inorganic filler such as a glass fiber to the thermoplastic resin 2, in the case of adding the inorganic filler in this manner, a modulus of elasticity of the completed core drill can be more improved and a modulus of shrinkage of the drill material 4 after injection molded can be restricted to be small, so that a core drill having a high strength and a high size accuracy can be manufactured. Further, in the case of adding the glass fiber, the glass fiber is useful for grinding the work as well as the abrasive grain, so that in comparison with the case of not adding it, a grinding efficiency of the core drill for the work can be increased.

Figure 5:
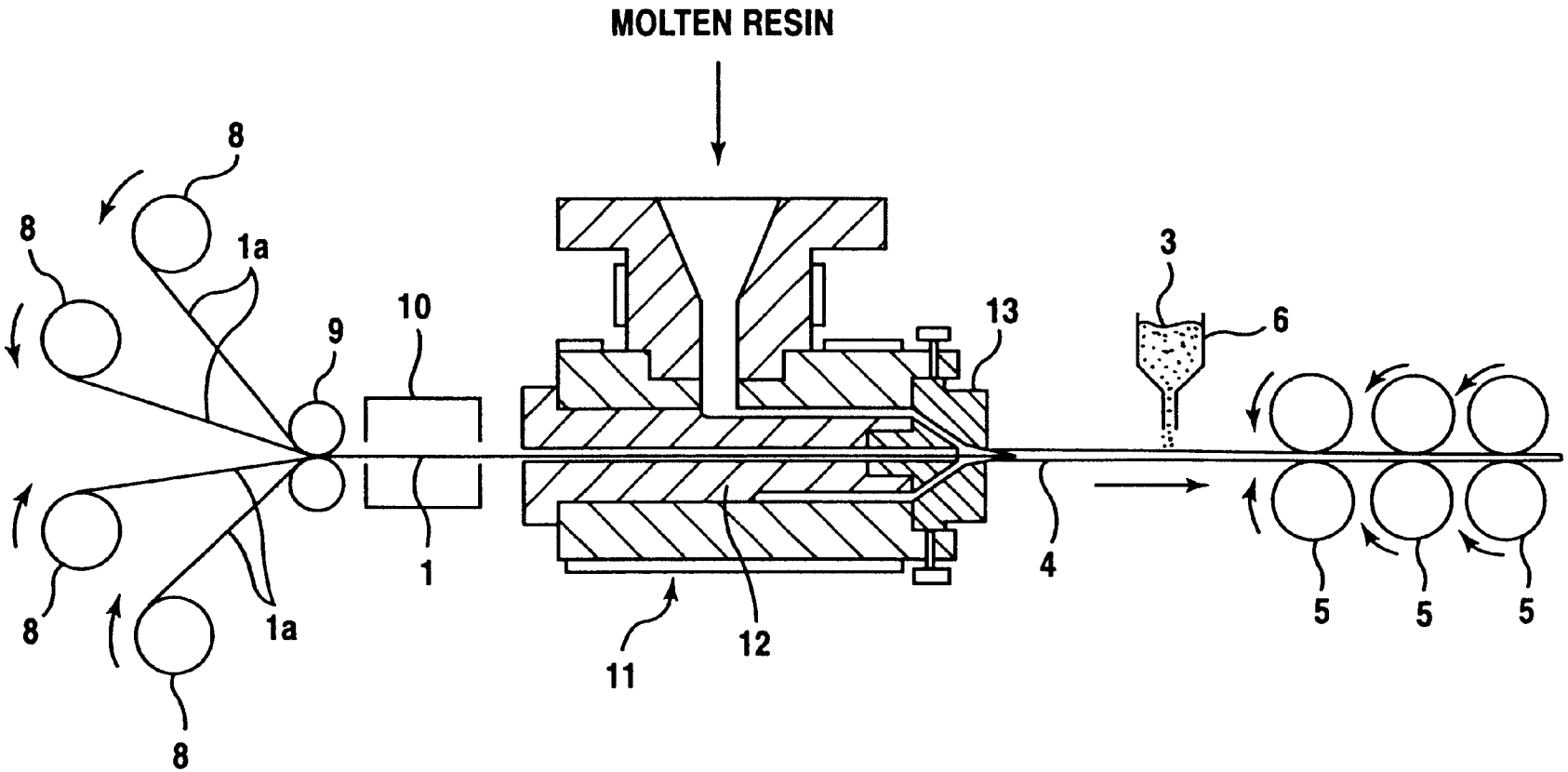
FIG. 5 is a schematic view which shows a manufacturing method of continuously forming a long core drill by using an extrusion molding of a synthetic resin.

FIG. 5 shows another method of manufacturing a core drill.

In the manufacturing method mentioned above, the drill material 4 having a length of about 300 to 400 mm is formed by an injection molding, and a insertion of the abrasive grain 3 and a finishing of the diameter are performed in each of the drill materials 4, however, the manufacturing method in the drawing is structured such as to continuously perform the forming of the core material 1 to the final finishing of the diameter.

The ceramics fiber constituting the core material 1 is wound around a plurality of reels 8 each having a great diameter, fed out therefrom, and inserted between holding rollers 9 so as to become the core material 1. The formed core material 1 passes through a mandrel 12 of a cross head die 11 after heated by a pre-heater 10, so as to be drawn out from a forming die 13. On the contrary, a molten thermoplastic resin is pressed into the cross head die 11 by a screw (not shown), and fleshes out the periphery of the core material 1 at a time of being extruded out from the forming die 13. Accordingly, the long drill material 4 is continuously drawn out from the cross head die 11.

The drill material 4 drawn out from the cross head die 11 is inserted between the pressing rollers 5 and 5 arranged in a multiple stages after the abrasive grains 3 supplied from the hopper 6 are dispersed on the peripheral surface thereof, and in the same manner as that of the embodiment mentioned above, the insertion of the abrasive grain 3 and the finishing of the diameter are performed. As a result, the core drill finished to a predetermined diameter is continuously fed out from a portion between the pressing rollers 5 and 5 in the final stage, and the core drill in accordance with the invention is completed by breaking this to a suitable length.

In this case, also in this manufacturing method, it is not necessary to always use the pressing roller 5 for plastically forming the drill material 4, and the structure may be made such that the diameter of the drill material 4 is drawn by the die 7.

On the contrary, in each of the manufacturing methods mentioned above, the abrasive grain 3 is later inserted and fixed to the formed drill material 4, however, the structure may be made such that the abrasive grain 3 is previously dispersed into the molten thermoplastic resin and the drill material 4 is formed by using the abrasive grain dispersion type thermoplastic resin.

Figure 6:
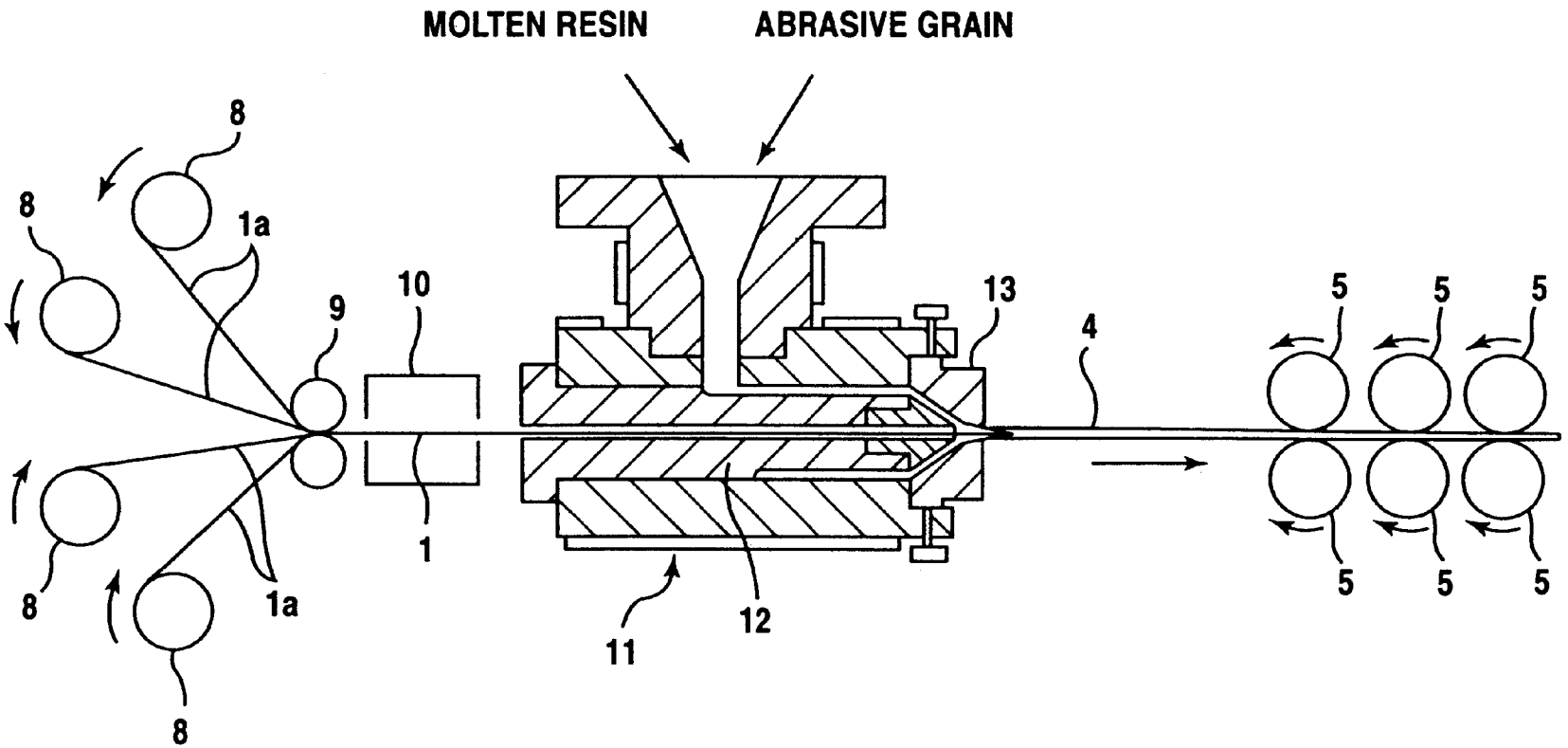
FIG. 6 is a schematic view which shows a manufacturing method of continuously forming a long core drill by dispersing an abrasive grain into a molten synthetic resin.

FIG. 6 shows a method of continuously manufacturing a long core drill by using an abrasive grain dispersion type thermoplastic resin. The manufacturing method is substantially the same as the method shown in FIG. 5, however, is different therefrom only in a point that a molten resin with abrasive grains 3 dispersed therein is pressed into the cross head die 11 and thus the hopper 6 of the abrasive grain 3 arranged in front of the pressing rollers 5 and 5 is omitted.

At a time of later attaching the abrasive grain 3 to the formed drill material 4, it is hard to uniformly attach the abrasive grain 3, however, in accordance with the manufacturing method shown in FIG. 6, since the drill material 4 is formed by using the thermoplastic resin 2 in which the abrasive grain 3 is previously dispersed, the abrasive grain 3 is uniformly held in the thermoplastic resin, so that an inclination of the abrasive grain 3 on the peripheral surface of the core drill can be easily prevented in comparison with the case that the abrasive grain 3 is later attached. Further, since the abrasive grain 3 is held not only on the surface of the core drill but also near the core material 1, the core drill is more suitable for a drilling which is performed by bringing a distal end thereof into contact with the work. On the contrary, in accordance with the manufacturing method mentioned above in which the abrasive grain 3 is held only on the surface of the core drill, the core drill is more suitable for a so-called lapping formation which grinds the prepared hole previously drilled on the work.

In this case, even in the case of inserting the core material broken at a predetermined length within the metal mold so as to form a short drill material, it is not necessary to later attach the abrasive grain to the formed drill material by performing an injection molding by using the thermoplastic resin in which the abrasive grain is previously dispersed, so that the core drill in accordance with the invention can be more easily manufactured.

Further, even in the case of using the thermoplastic resin as the synthetic resin, the core drill in accordance with the invention can be manufactured by substantially the same method as that of the thermoplastic resin mentioned above.

What is claimed is:

1. A core drill for drilling a fine hole into a worksurface or for grinding an inner diameter of the drilled fine hole to a predetermined shape, comprising: bundled ceramic long fibers defining a core material, hardened molten synthetic resin impregnating said core material, and plural abrasive grains partially embedded in and extending from the synthetic resin.

* * * * *